US005875936A

United States Patent [19]

Turbett et al.

[11] Patent Number: 5,875,936

[45] Date of Patent: Mar. 2, 1999

[54] REFILLABLE PUMP DISPENSER AND REFILL CARTRIDGE

[75] Inventors: James Lynn Turbett, Stamford, Conn.; Mark John Iaia, Valley Cottage, N.Y.

[73] Assignee: Chesebrough-Pond's USA Co., Division of Conopco, Inc., Greenwich, Conn.

[21] Appl. No.: 773,800

[22] Filed: Dec. 18, 1996

Related U.S. Application Data

[60] Provisional application No. 60/010,290 Jan. 22, 1996 and provisional application No. 60/018,909 Jun. 4, 1996.

[51] Int. Cl.[6] ..... B65D 37/00; B67D 5/32; B67D 3/00

[52] U.S. Cl. ..... 222/207; 222/153.13; 222/82; 222/89; 222/836

[58] Field of Search ..... 222/207, 153.13, 222/89, 82, 536

[56] References Cited

U.S. PATENT DOCUMENTS

| | | | |
|---|---|---|---|
| 3,162,334 | 12/1964 | Miller . | |
| 3,486,663 | 12/1969 | Humphrey . | |
| 3,752,366 | 8/1973 | Lawrence, Jr. . | |
| 3,907,174 | 9/1975 | Steiman | 22/153.13 |
| 3,998,348 | 12/1976 | Sammaritano . | |
| 4,074,147 | 2/1978 | Schmidt | 222/89 |
| 4,265,372 | 5/1981 | Wainberg | 222/82 |
| 4,322,020 | 3/1982 | Stone . | |
| 4,469,250 | 9/1984 | Evezich . | |
| 5,004,123 | 4/1991 | Stoody . | |
| 5,005,733 | 4/1991 | Stoody . | |
| 5,012,956 | 5/1991 | Stoody . | |
| 5,139,168 | 8/1992 | Gueret . | |
| 5,277,015 | 1/1994 | Brown et al. | 222/105 |
| 5,476,322 | 12/1995 | Stoody | 383/33 |
| 5,477,985 | 12/1995 | Gueret | 222/95 |
| 5,492,251 | 2/1996 | Albini et al. | 222/153.13 |
| 5,505,341 | 4/1996 | Gueret | 222/207 |
| 5,524,799 | 6/1996 | Skillin | 222/536 |
| 5,642,838 | 7/1997 | Stoody | 222/82 |

*Primary Examiner*—Kevin P. Shaver
*Assistant Examiner*—Keats Quinalty
*Attorney, Agent, or Firm*—Milton L. Honig

[57] ABSTRACT

A refillable dispenser and refill cartridge is described for dispensing a product through a pumping mechanism that draws product from the cartridge. Product is pumped upwards from the refill cartridge through a connector tube, across a one-way check valve into a collecting chamber from which it is dispensed through a one-way monitoring valve and exits a nozzle. Flow is initiated by compression of a domed elastomeric wall covering the collecting chamber.

14 Claims, 9 Drawing Sheets

REFILLABLE PUMP DISPENSER AND REFILL CARTRIDGE

BACKGROUND OF THE INVENTION

This application claims benefit of Provisional Applications Ser. No. 60/010,280 filed Jan. 22, 1996 and Provisional Ser. No. 60/018,909, filed Jun. 4, 1996.

FIELD OF THE INVENTION

The invention concerns a refillable, non-vented pump dispenser and refill cartridge for delivery of liquid and semi-liquid products.

THE RELATED ART

Refillable dispensers provide one answer to our environmental concern over garbage disposal. Containers which would normally be trashed, or at best partially recycled, can with a refill concept be reused numerous times. This represents the most convenient way for consumers to help reduce landfill waste. Moreover, recycling costs are lowered with respect to collecting, storing and disposing of plastic containers.

A popular approach to the refill concept has been assemblies in which the product to be dispensed is contained within a flexible pouch. Assemblies of this kind are used more particularly in cases where the distributor head, associated with the flexible pouch, forms a pump without recirculation of air or in the case of dispensers of the aerosol variety in which product is introduced into a flexible pouch and a propellant is introduced into a can surrounding the pouch.

Flexible pouches usually consist of a bag comprising two walls of variable shape, e.g. rectangular, the walls being welded at least on one side. The flexible pouch is fixed in the sealed manner, usually by means of welding to a distributor head. As product is dispensed, the flexible pouch gradually empties and, consequently, its walls draw together. Therefore, the two walls often come into contact with one another before all of the product has been dispensed. These walls stick together over one or several zones, wherein the zones can then form an impenetrable barrier. Part of the product to be dispensed is trapped in this manner. It then becomes impossible to dispense it. Losses resulting from trapping can be quite considerable.

U.S. Pat. No. 5,139,168 (Gueret) reports mitigating the trapped product problem by introducing within the flexible pouch a semi-rigid screen parallel to the output axis of the product. By virtue of this screen, it is possible to keep the walls of the flexible pouch at a distance from one another to prevent them sticking together and blocking flow.

Nursing bottles have also presented a similar problem of irregular collapse. U.S. Pat. No. 3,998,348 (Sammaritano) discloses a nursing bottle assembly with a flexible inner bag being biased at its lower end by a roller assembly. The assembly includes a cylinder which applies continuous pressure against the flexible bag and moves upwards as product is dispensed.

A less intrusive, more economical system for avoiding trapped product pockets is disclosed in a series of patents to Stoody including U.S. Pat. No. 5,004,123; U.S. Pat. No. 5,005,733, U.S. Pat. No. 5,012,956 and U.S. Pat. No. 5,476,322. These patents are all based on the concept of a collapsible flaccid bag provided with a passive mechanism for managing collapsing that avoids fluid retention pockets without regard to attitude of the containment bottle. The passive mechanism is described as a flimsy, substantially rectangular shaped film of plastic which extends from the bottom region of the bag to a short distance from its outlet. The Stoody patents describe a variety of dispensing heads including pumps and nipple fitted squeeze bottles. Still better dispensing mechanisms are required before this flaccid bag technology could be turned into a commercially viable system.

Accordingly, it is an object of the present invention to provide a refillable pump dispenser where product flow can be very precisely controlled to deliver even fractional portions of a full pumping stroke.

Another object of the present invention is to provide a refillable pump dispenser of relatively low profile which can be more readily stored than those of the known art.

Still another object of the present invention is to provide a refillable pump dispenser with an actuating member which can be depressed by hand pressure from practically any angle.

Yet another object of the present invention is to provide a refillable pump dispenser capable of receiving a refill cartridge which can be quickly and easily loaded into the dispenser without mixing, pouring, spillage or messiness.

Still a further object of the present invention is to provide a refill cartridge suitable for a refillable pump dispenser wherein the cartridge is formed of a flexible pouch, capable of standing alone on its cap, is provided with a large outer surface for receiving graphics and can evacuate over 90% of its product contents.

Still another object of the present invention is to provide a refill cartridge suitable for a refillable pump dispenser having a mechanism allowing a consumer to easily load/unload the cartridge while eliminating the possibility of air inadvertently entering the cartridge thereby maintaining a vacuum responsible for product delivery.

SUMMARY OF THE INVENTION

A refillable pump dispenser is provided including:

(i) a container having a closed and an open end storing a pumpable product;

(ii) a pump mechanism for drawing the product from the container and dispensing same, the pump mechanism being positioned over the open end of the container and including:

(a) a connector tube with upper and lower ends;

(b) a collecting chamber for receiving product drawn upward from the connector tube;

(c) a one-way check valve interposed between the upper end of the connector tube and the collecting chamber;

(d) an elastomeric wall at least partially positioned over and communicating with the collecting chamber, the elastomeric wall being resiliently pressable thereby compressing the collecting chamber;

(e) a dispensing member communicating with the collecting chamber having an exit orifice through which product can flow outward;

(f) a one-way monitoring valve downstream from the collecting chamber controlling the outward flow through the dispensing member; and (g) a refill cartridge positioned within the container, the cartridge having a dispensing end communicating with the connector tube and through which product is drawn.

Not only does the invention concern itself with a refillable pump dispenser but stand-alone refill cartridges are also the subject of this invention. These refills offer a modular approach. No longer is it necessary to throw away a dispenser of considerable plastic construction. Use of the refill helps reduce landfill waste. The refill cartridge is simple to insert, requires no mixing, no pouring, no spillable and results in no mess. Constructions of the present invention also achieve more than 90% evacuation of product compared to the 60–70% with ordinary dispensers. Not only is the consumer benefitted but manufacturers gain because they do not have to overfill to achieve the labelled contents. Neither does the product at any time contact surfaces of the container. For this reason, recycled plastic can be employed for such container without fear of safety/contamination issues. A still further aspect of this invention is that the same refillable pump dispenser can be fitted with different capacity refills. These refills may be in the form of collapsible pouches.

A preferred embodiment of the collapsible pouch is a passive flaccid bag having integral therewith at least one passive mechanism that manages collapsing of the bag. Particularly effective as the passive mechanism is a flimsy, substantially rectangular shaped film of plastic extending from a bottom region of the bag to a short distance from the dispensing end. The plastic film maintains bag rigidity to assure complete emptying of the bag at final stages of aspirating product.

Advantageously the pouch will include an annular fitment across the dispensing end for securing walls of the bag thereto. The annular fitment may be provided with a frangible septum. A sharpened mouth can be formed at the lower end of the connector tube for puncturing the septum to begin product flow. Puncture can be triggered through joinder of the cartridge to the pump mechanism. The sharpened mouth may be achieved by having an acute angle cut traversing a longitudinal axis of the connector tube.

An upwardly rising annular wall may be formed on a top surface of the fitment. A retaining mechanism along an upper edge of the annular wall can be useful for supporting thereunder a cover. A plurality of prongs may be employed as the retaining mechanism. Label information and graphics can be printed onto this cover. Moreover, the cover can serve as a means for shielding the bag contents from use and other airborne contamination. When a refill cartridge is ready for insertion into the dispenser, the cover is simply removed.

Another structure that may be associated with the annular fitment is at least one projection extending from the upper surface thereof. A catch mechanism can be located on the projection for the purpose of coupling same to the pump mechanism.

Still a further useful structure is at least one arm positioned below the collecting chamber and directed downwardly. The arm includes a complementary catch mechanism for releasably joining same to the catch mechanism on the at least one projection.

In a second embodiment of the refill cartridge, a tapered cone receptacle rises upwardly from a top surface of the fitment. The tapered cone receptacle is sized as a female connection to receivably match the complementary tapered lower end of the connector tube. A more efficient airtight and positive engagement is thereby achieved between the collapsible pouch and pump mechanism. This arrangement forms the equivalent of a Luer lock system.

As a further optional feature a doughnut shaped laminate film is inserted as a seal below an undersurface of the annular fitment. Sealing occurs against a flange defining an upper surface of a pouch ring against which the collapsible bag is attached. The annular fitment is snapped over the flange of the pouch ring with the laminate film sandwiched therebetween. Application of heat adhesively bonds the fitment to the pouch ring. The laminate film can be formed of multiple layers, most preferably three layers. Upper and lower layers consist of low density polyethylene between which is a layer of foil (e.g. aluminized polyester). Still another feature represented by a further embodiment is use of a cage inside the collapsible pouch structured as an extended sleeve. The cage prevents the pouch from prematurely collapsing thereby closing itself off during product evacuation.

Yet another aspect of the invention is a ring collar positioned around an open mouth of the container. The annular fitment with attached pouch seats within the ring collar. The pump mechanism surrounds the ring collar. A locking device is present on the ring collar for releasing the pump mechanism from the container and thereby permitting exchange of the cartridge for a new refill.

Advantageously, the dispenser may have an oval cross-section. Likewise, the pouch and/or annular fitment may also be of oval cross-section. Major advantages of the oval configuration are that the dispenser will have greater visibility on a shelf and more of its graphics can be viewed by potential consumers without tedious handling of the package.

BRIEF DESCRIPTION OF THE DRAWING

The above objects, features and advantages of the present invention will become more clearly understood in connection with the detailed description of preferred embodiments, when considered with the accompanying drawing in which.

DETAILED DESCRIPTION OF THE INVENTION

Figure 1:
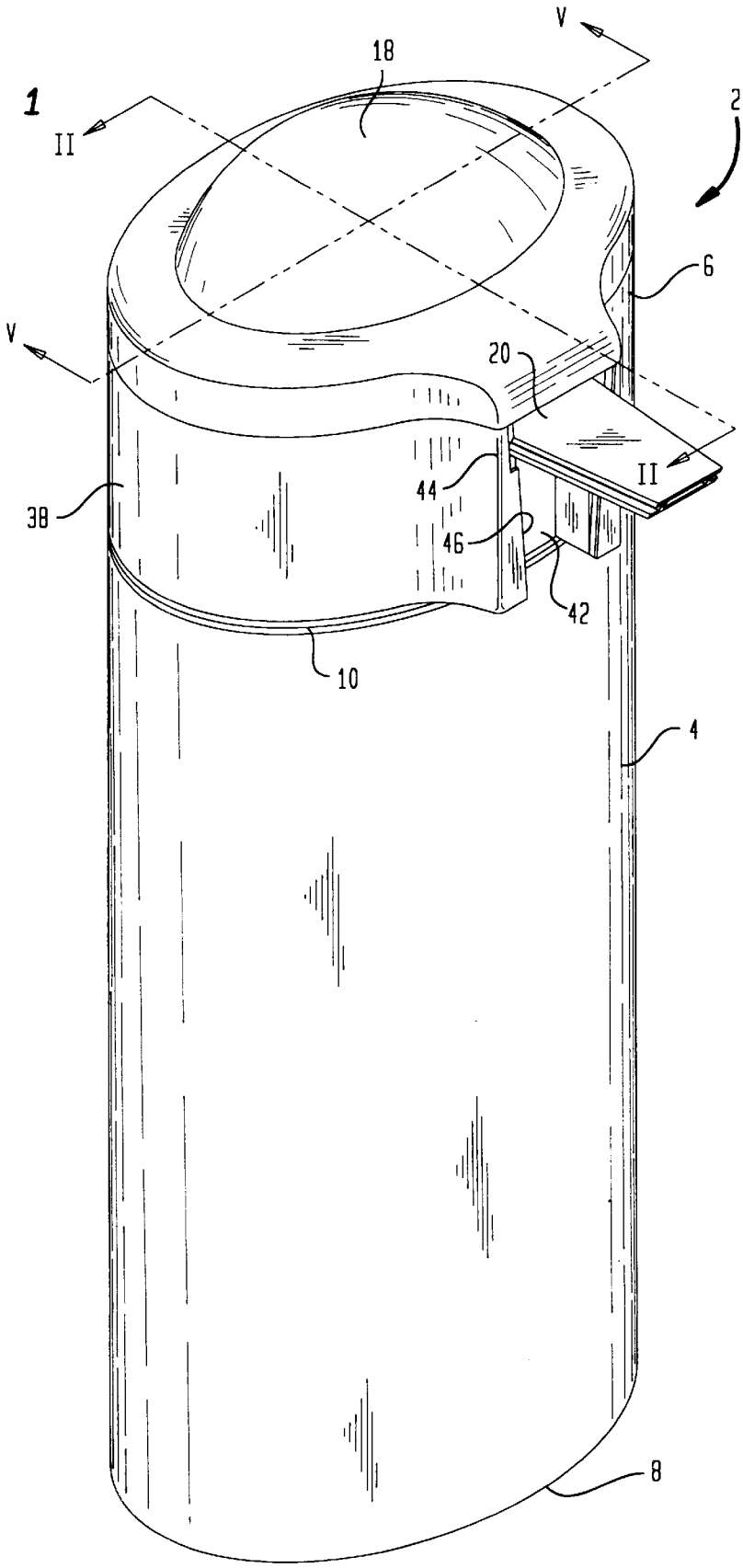
FIG. 1 is a front elevational view of a pump dispenser according to the present invention.

According to the present invention there is provided a pump dispenser 2 consisting of a container 4 mounted with a pump mechanism 6. Container 4 has a closed end 8 and an open end 10. Pump mechanism 6 is positioned over the open end of the container.

Figure 2:
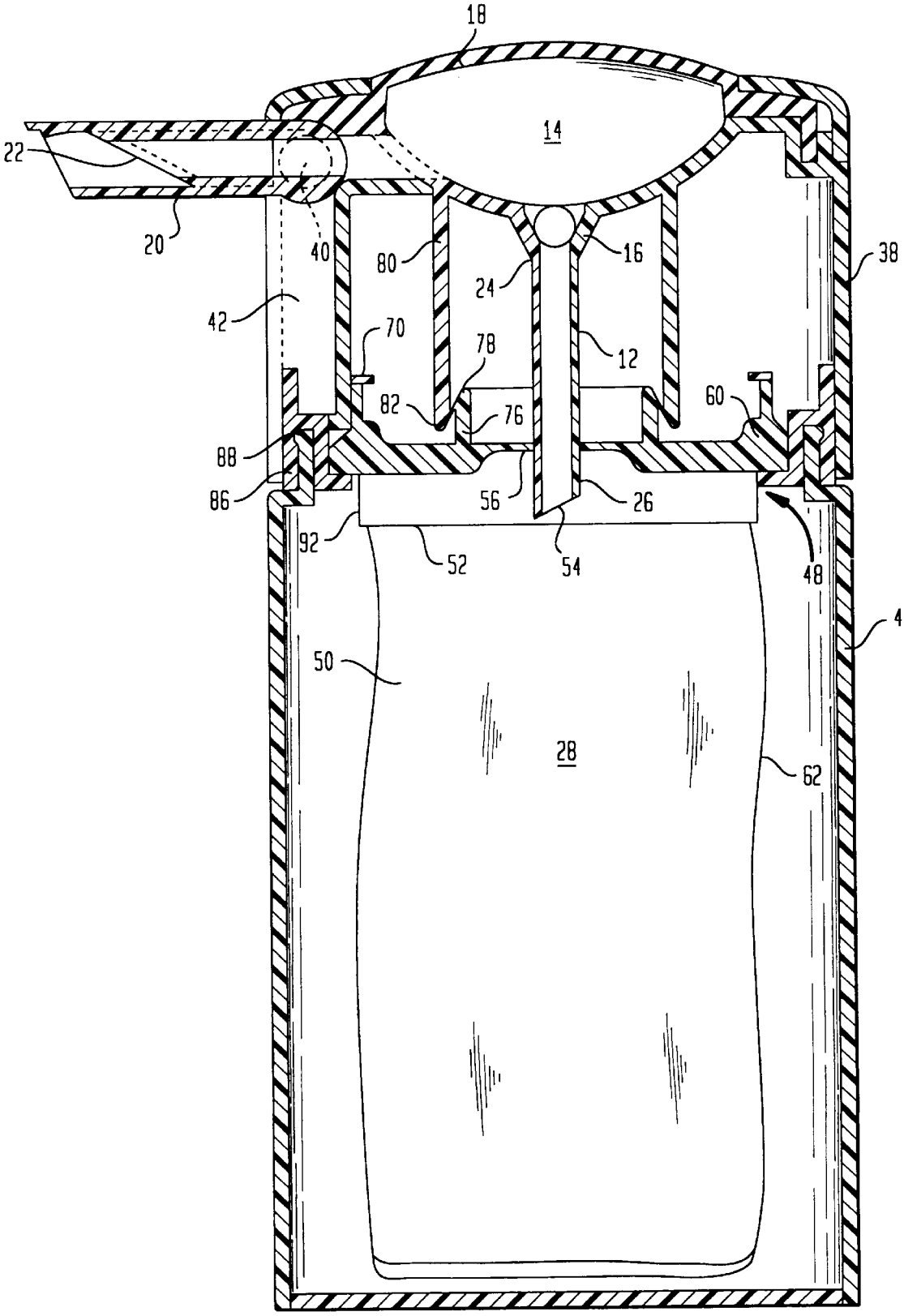
FIG. 2 is a cross-sectional view of the pump dispenser shown in FIG. 1 taken along line 2—2.
Figure 3:
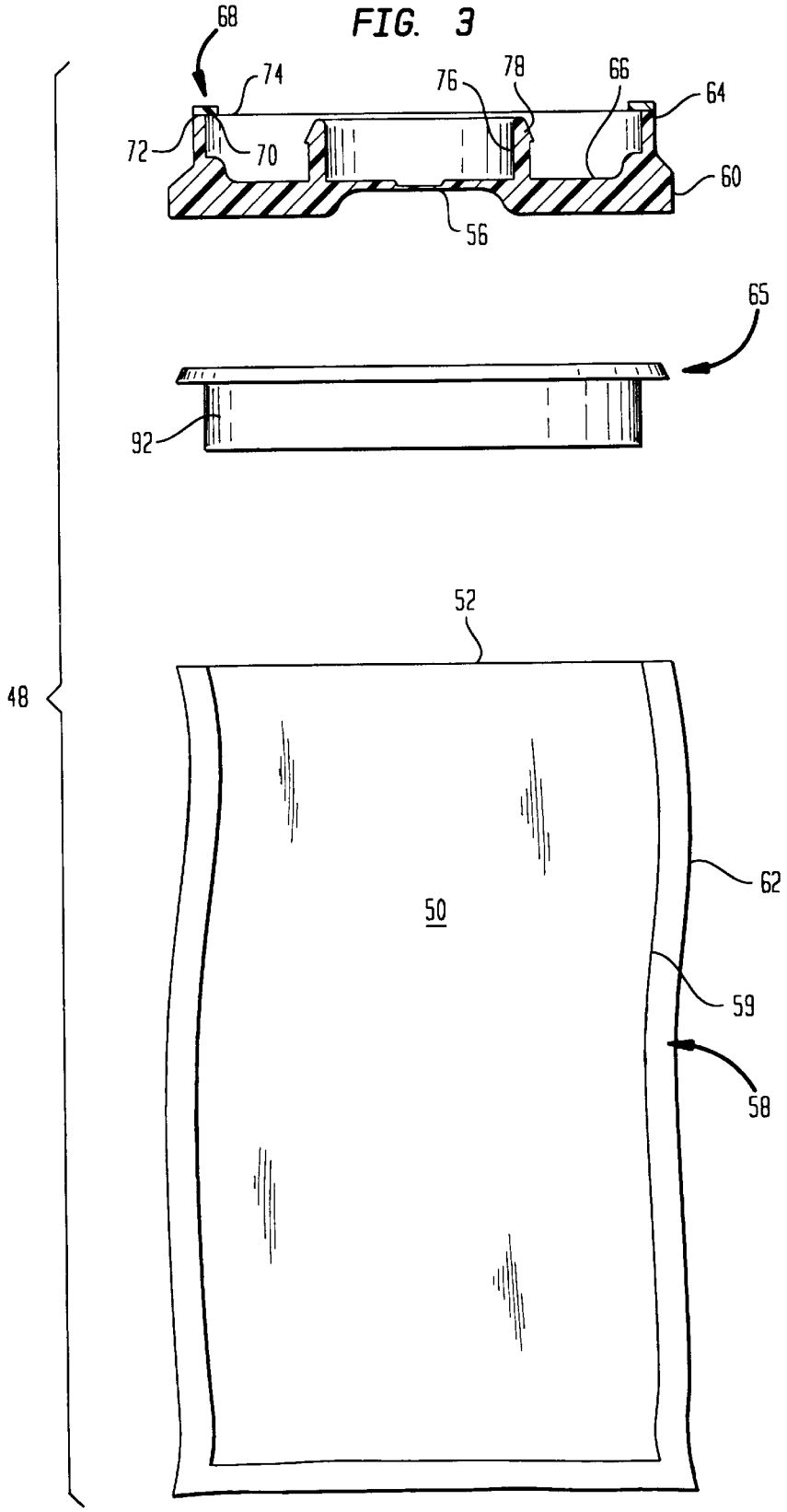
FIG. 3 is an exploded view of a refill cartridge according to the cartridge embodiment shown within the pump dispenser of FIG. 2.

FIGS. 1 and 2 illustrate the pump mechanism 6 which includes a connector tube 12, a collecting chamber 14, a one-way check valve 16, an elastomeric wall 18, a dispensing member 20 and a one-way monitoring valve 22. Connector tube 12 has an upper end 24 and a lower end 26, the lower end extending downward into container 4 to draw product 28 therefrom. Collecting chamber 14 receives product 28 drawn upward from the connector tube 12. One-way check valve 16 is interposed between the upper end 24 of the connector tube 12 and the collecting chamber 14. The elastomeric wall 18 is a dome-shaped structure at least partially positioned over and communicating with the collecting chamber 14. The elastomeric wall is resiliently pressable downwardly. When activated, the elastomeric wall compresses the collecting chamber. The dispensing member 20 communicates with the collecting chamber to allow product flow therebetween. The one-way monitoring valve 22 is positioned downstream from the collecting chamber 14. This monitoring valve controls outward product flow through the dispensing member.

Dispensing member 20 is formed as a turret nozzle pivoting on a pair of pinions 40. The nozzle can assume a closed position by nesting within elongate recess 42 formed in apron 38. Recess 42 is defined by a pair of parallel sidewalls 46. Pinions 40 are rotatingly seated into complementary indentations 44 of sidewalls 46. Dispensing member 20 can pivot through an arc of at least 60°, preferably through an arc of 90°.

Within container 4 rests a cartridge 48 whose main feature is a collapsible pouch 50 for closed containment of product 28. Pouch 50 through its dispensing end 52 communicates with the lower end 26 of the connector tube 12. Lower end 26 has a sharpened mouth 54 capable of piercing a frangible septum 56 covering the upper end of the pouch. Puncture of the septum will occur upon joinder of cartridge to pump mechanism. Sharpened mouth 54 traverses a longitudinal axis of the connector tube at an acute angle.

Pouch 50 in a preferred embodiment is a passive, flaccid bag having integral therewith at least one passive mechanism 58 that manages collapsing of the bag. Exemplative of the passive mechanism is a flimsy, substantially rectangular shaped film 59 formed of plastic. Film 59 extends from a bottom region of the bag to a short distance from the dispensing end. The film assures complete emptying of the bag at final stages of aspirating product.

Across the dispensing end of pouch 50 is an annular fitment 60 covering a pouch ring 65 for securing walls 62 of the pouch thereto. A rigid sleeve 92 extends downwardly as an apron along a circumference of the pouch ring. The rigid sleeve 92 helps to secure assembly of pouch 50 to the annular fitment 60.

Frangible septum 56 is formed as a central section of the annular fitment 60. An annular wall 64 rises upward from top surface 66 of the fitment. A retaining mechanism 68, particularly in the form of a plurality of prongs 70, is situated along an upper edge 72 of the annular wall and supports thereunder a cover 74. Label graphics may be printed onto cover 74.

At least one projection 76 extends from the top surface 66 of the annular fitment. A catch mechanism 78 on the at least one projection couples same to the pump mechanism 6. Furthermore, at least one arm 80 is positioned below the collecting chamber 14 and is directed downwardly toward pouch 50. Arm 80 includes a complementary catch mechanism 82 for releasably joining same to the catch mechanism 78 on projection 76.

Figure 4:
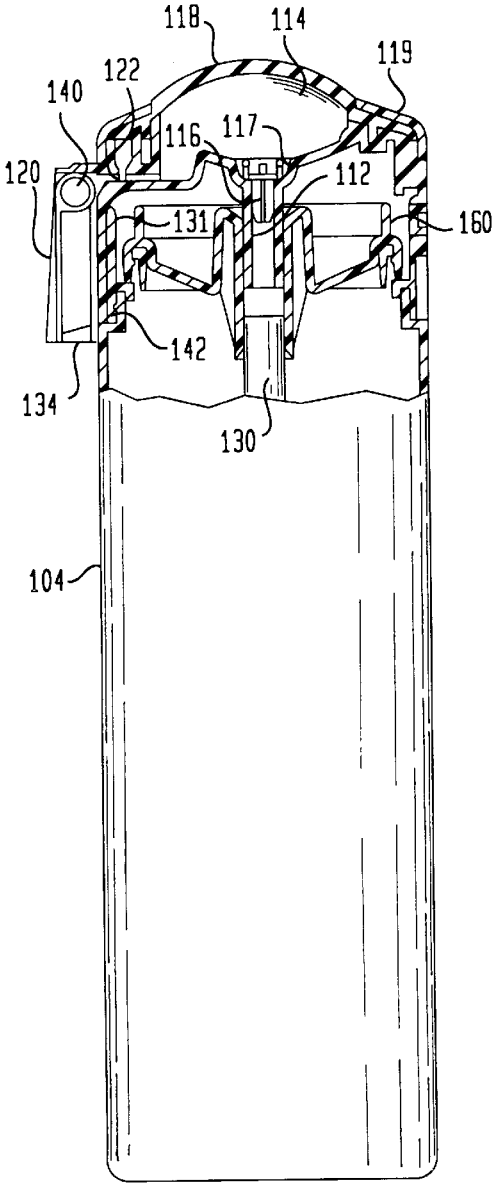
FIG. 4 is a cross-sectional view of a second embodiment of the pump dispenser shown in FIG. 1 taken along line 2—2 except with turret nozzle in closed position.
Figure 5:
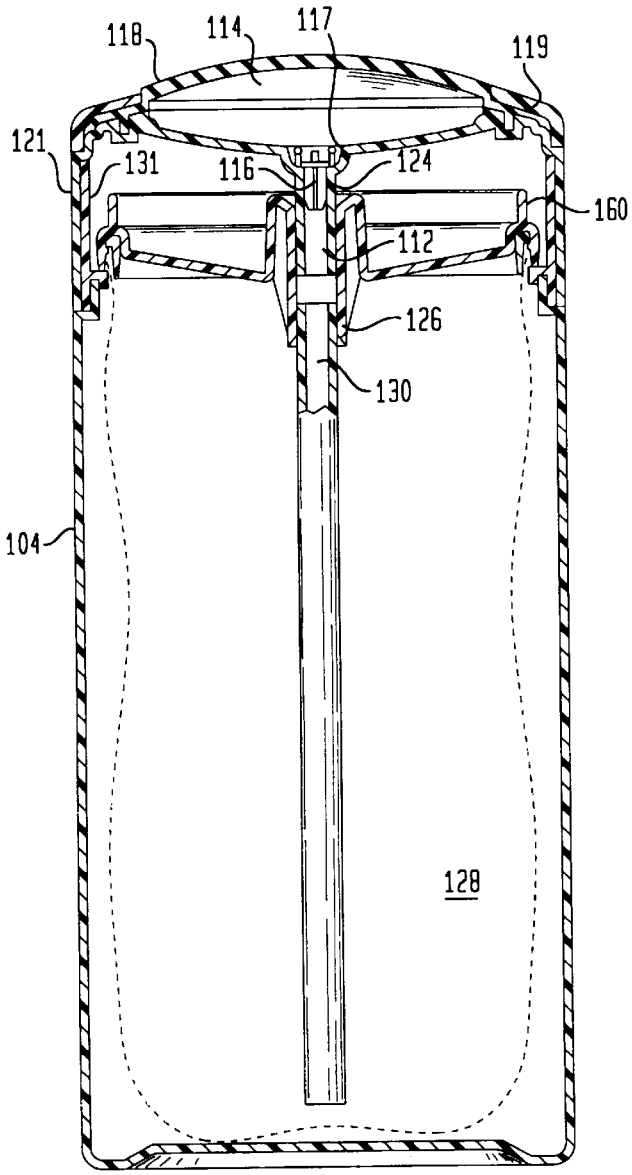
FIG. 5 is a cross-sectional view of a second embodiment of the pump dispenser shown in FIG. 1 taken along line 5—5.
Figure 6:
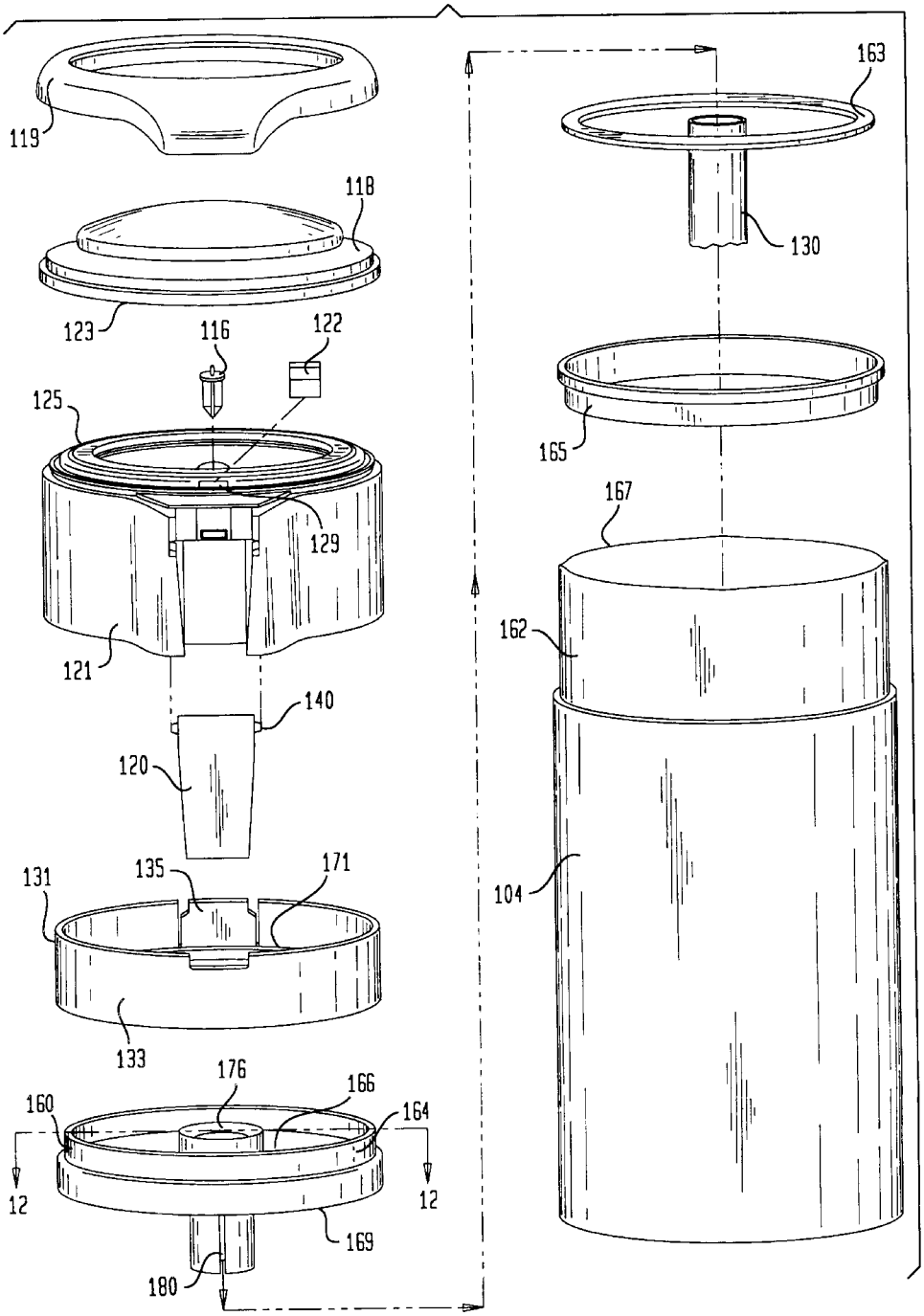
FIG. 6 is an exploded view showing the component parts of the pump dispenser embodiment of FIGS. 4 and 5.

FIGS. 4, 5 and 6 illustrate a second embodiment of the pump dispenser. Similar to the first embodiment, the pump mechanism includes a connector tube 112, a collecting chamber 114, a one-way poppet valve 116, an elastomeric wall 118, a dispensing member in the form of a turret nozzle 120 and a one-way monitoring flap valve 122. Connector tube 112 has an upper end 124 and a lower end 126, the latter projecting downward into the pouch. Dip tube 130 is attached to and further extends the connector tube 112 to a bottom of the pouch to draw product 128 therefrom. Slot openings 180 on the lower end of the connector tube allow product intake from a second, higher area. Withdrawal from top and bottom areas overcomes premature pouch wall collapse ordinarily trapping pockets of product. Operation of the dispenser is similar to that already described in connection with the first embodiment of the pump dispenser.

FIG. 6 provides a disassembled view of the various component parts forming the second embodiment of the pump dispenser. Collecting chamber 114 is covered by the elastomeric wall formed as a dome 118. Snap ring 119 is shaped to snap-on over a perimeter of the dome to seal and secure same to a shell cap 121. Further sealing is achieved through a bead 123 along a perimeter on an underside of the dome fitting within a channel 125 on an upper side of shell cap 121. One-way poppet valve 116 is located within a receiving aperture 117 centrally positioned in a floor of the collecting chamber 114.

Figure 7:
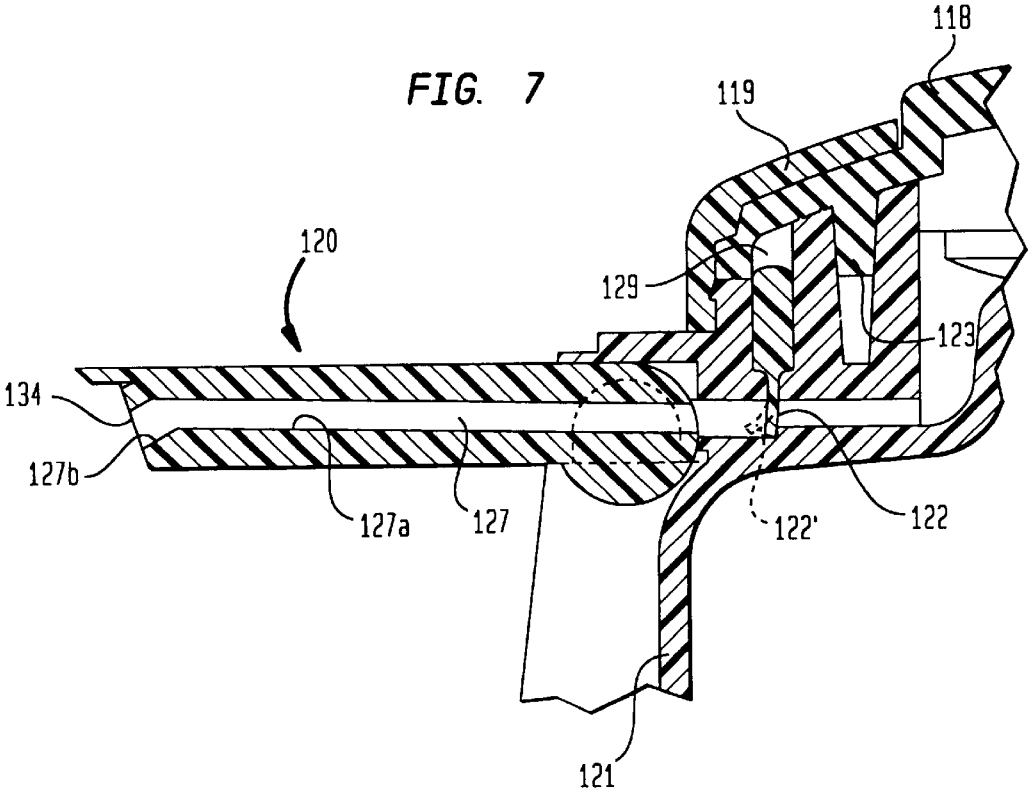
FIG. 7 is a partial view in cross-section of the turret nozzle and surrounding area according to the second embodiment shown in FIG. 4.

A one-way monitoring flap valve 122 is fashioned as a thin elastomeric flap inserted within a complementary recess 129 having an opening along the top of the shell cap 121. FIG. 7 provides an expanded view in cross-section of flap valve 122 showing the valve in the closed position. The open position is illustrated through the phantom flap valve 122'. Product flowing through the flap valve enters spout channel 127 having a straight section **127*a* and a downwardly tapered portion 127*b*, the latter adjacent an outlet opening 134** of the turret nozzle. The downwardly tapered portion of the channel functions to dispense product in a downwardly direction.

Figure 8A:
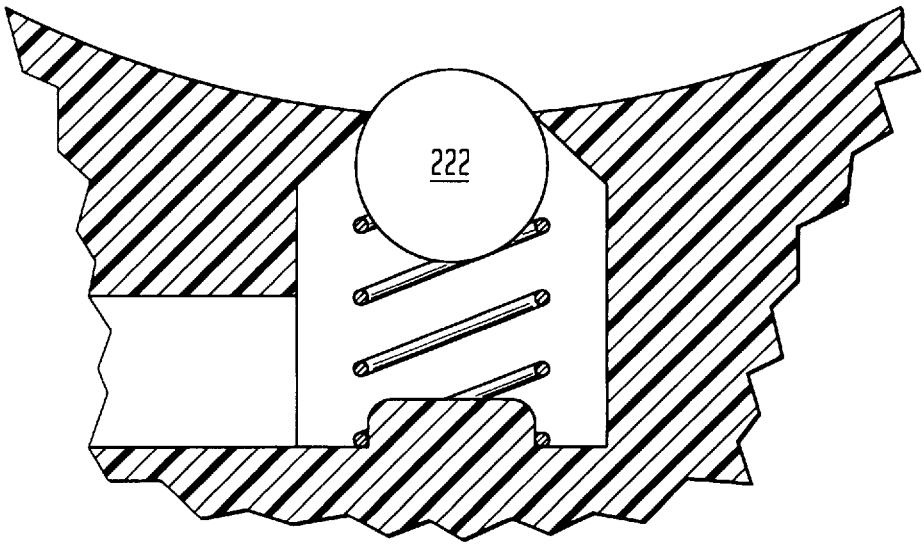
FIG. 8A is a schematic partial view in cross-section of a second embodiment of the one-way monitoring valve.
Figure 8B:
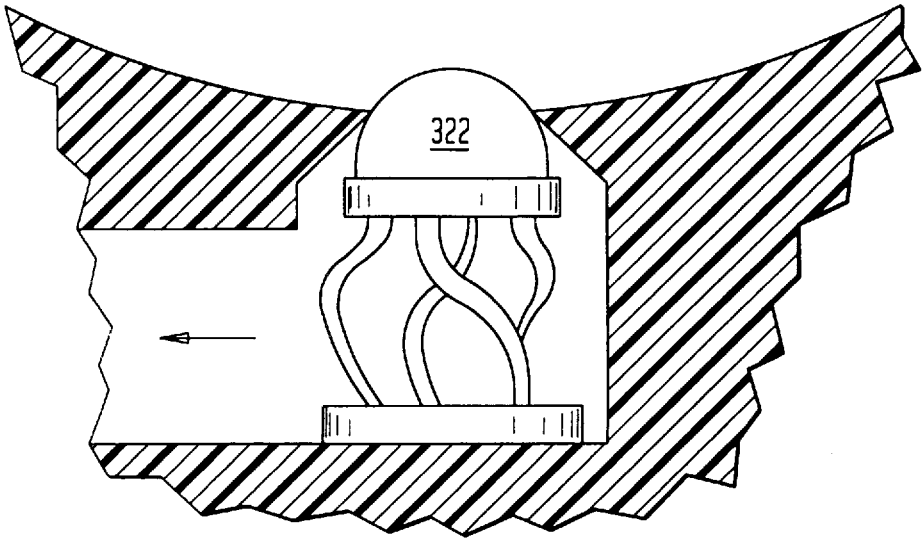
FIG. 8B is a schematic partial view in cross-section of a third embodiment of the one-way monitoring valve.

A variety of alternative one-way monitoring valve may substitute for flap valve 122. FIG. 8A illustrates a top loaded metal spring and ball valve 222 as one alternative. FIG. 8B illustrates a top loaded plastic molded spring action poppet 322 which can also substitute for the flap valve.

Figure 9:
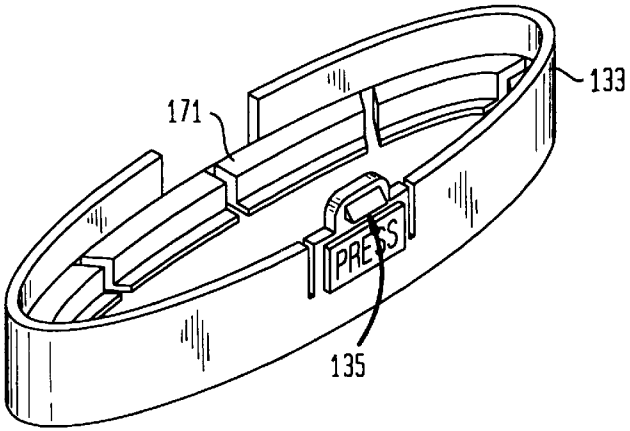
FIG. 9 is a front perspective view of the ring collar component shown with the pump dispenser of FIG. 6.

A ring collar 131 snap fits onto container 104 and has an apron 133 serving as an outer wall. Shell cap 121 is removably insertable over collar 131, removability being facilitated by a locking tab 135 formed as a U-shaped inwardly flexible section of the apron 133. FIG. 9 best illustrates locking tab 135. The pump mechanism represented by the snap ring, elastomer dome, and shell/nozzle is released from the ring collar by inward thumb pressure on the locking tab 135 thereby activating disengagement.

Annular fitment 160 covers the mouth of pouch 162. The annular fitment includes an induction seal liner 163 and a pouch ring 165. Edges 167 along the open end of pouch 162 are draped over the pouch ring 165 and secured to an underside of the induction seal liner of the annular fitment. In an alternative embodiment it is also possible to eliminate the pouch ring and liner by sealing edges of the pouch directly to an underside of the annular fitment 160.

When the dispenser is assembled, the annular fitment 160 rests within apron walls 133 supported through edge 169 against ledge 171 projecting inwardly around an interior surface of the apron walls.

Figure 12:
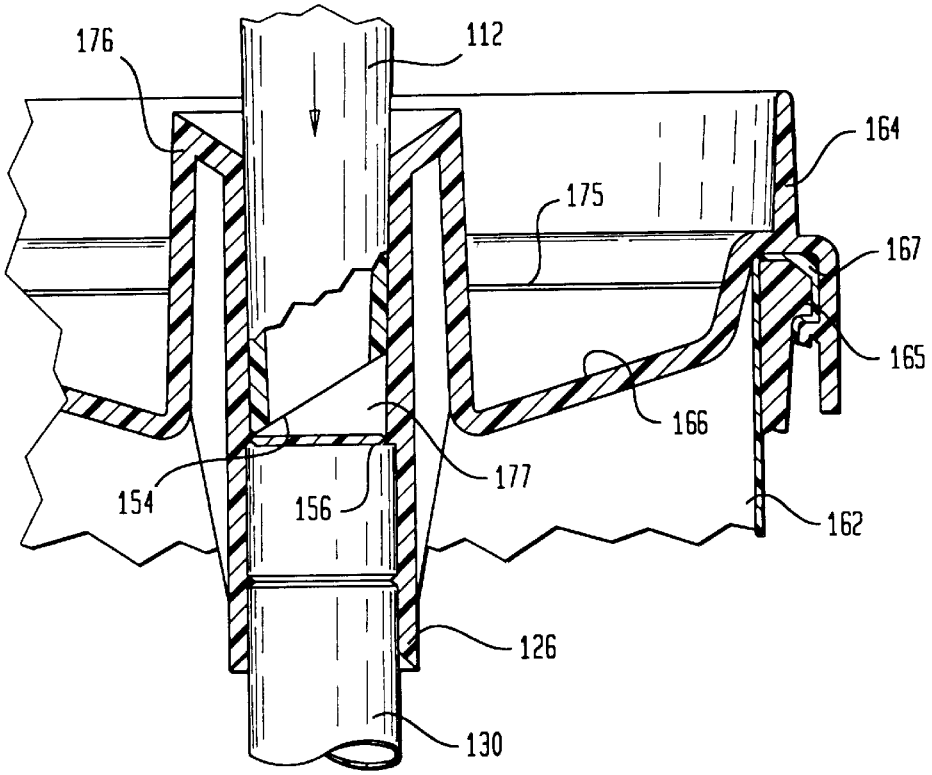
FIG. 12 is a partial view in cross-section of the annular fitment taken along line 12—12 of FIG. 6.
Figure 10:
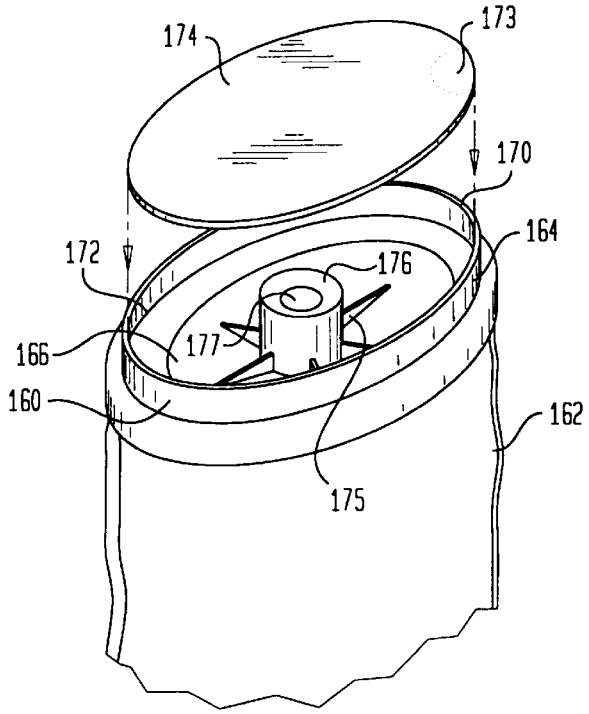
FIG. 10 is a perspective view of a third embodiment of the refill cartridge, with only partial representation of the collapsible bag and a dust cover in a removed position to reveal underlying structures combining aspects of the other two annular fitment embodiments shown respectively in FIGS. 3 and 6.
Figure 11:
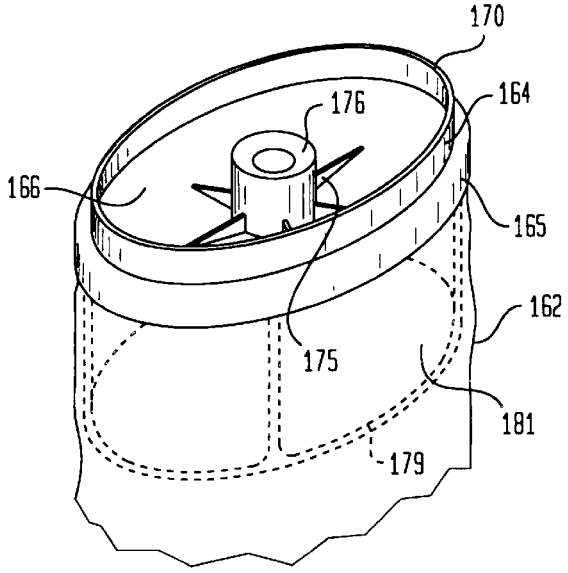
FIG. 11 is similar to the embodiment of FIG. 10 but in phantom reveals a support cage within the collapsible bag.

FIGS. 10 through 12 illustrate in more detail further variations of the refill cartridge. An annular wall 164 rises upward from top surface 166 of the annular fitment 160. Optionally, a retaining mechanism in the form of a ring 170 is situated along an upper edge 172 of the annular wall supporting thereunder a dust cover 174. Perforated thumb notch 173 is patterned along a corner of the dust cover (paperboard). Pressure on the thumb notch can easily fracture this segment along the perforations to allow for easy removal of the dust cover. Removal is normally performed just prior to use of the refill.

A tapered cone receptacle 176 extends upward from the top surface 166 of the annular fitment. A series of six ribs 175 radiate outward from the tapered cone receptacle for purposes of support.

FIG. 12 best illustrates through cross-sectional view the tapered cone receptacle. Central recess 177 has sidewalls which are configured in a slight taper (ranging from 0.5° to 5°, preferably 2°) to match the taper of the spiked connector tube. These complementary configurations are intended to provide an airtight, positive engagement with the pump through a friction Luer locking fit. Frangible septum 156 stretches across a full bore of the central recess 177 to seal contents of the pouch. Breakage of the seal is achieved when sharpened mouth 154 of connector tube 112 pierces attachment edges of septum 156.

FIG. 11 illustrates a cage 179 molded as an extension of the pouch ring 165. Cage 179 includes a series of windows 181, preferably at least four in number, and is positioned within the collapsible pouch 162. Purpose of the cage is to prevent the bag from prematurely collapsing and shutting itself off during product evacuation.

Figure 13:
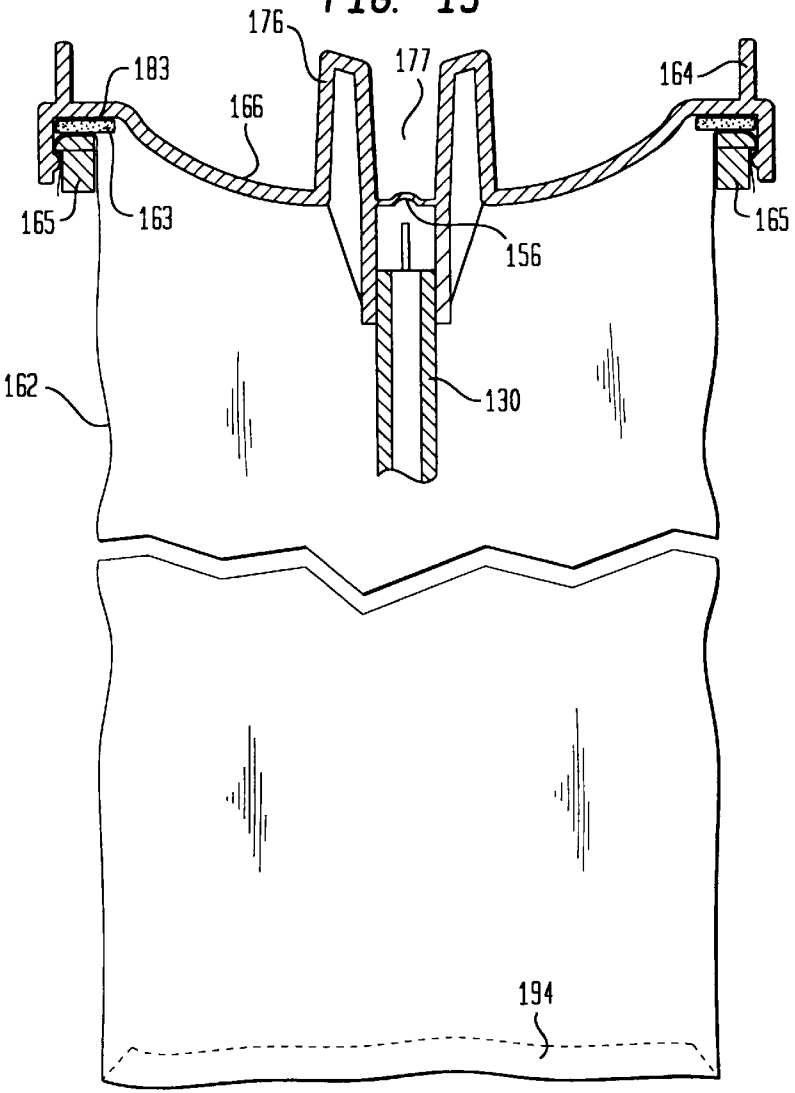
FIG. 13 is a cross-sectional view of the annular fitment and pouch ring showing a laminate film therebetween.
Figure 14:
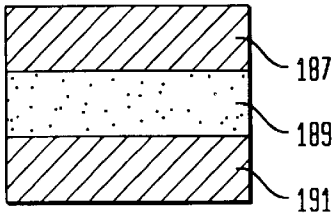
FIG. 14 is a cross-sectional view of the laminate film seal of FIG. 13.

FIG. 13 illustrates the presence of a laminate film 186 seal as a doughnut-shaped object separating an undersurface 183 of the annular fitment from a flange 185 along an upper surface of the pouch ring 165. Heat activates the laminate film to adhesively bond the flange to the under surface of the annular fitment. FIG. 14 is a cross-section through the laminate film 186 showing an upper layer 187 (low density polyethylene), a middle layer 189 (foil) and lower layer 191 (low density polyethylene).

Figure 15:
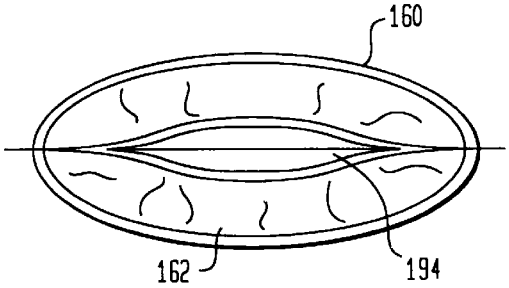
FIG. 15 is a bottom plan view of a gusseted pouch refill cartridge.

FIG. 15 illustrates pouch 162 with a gusseted bottom. The gusset is formed from opposing outer walls at a lower end of the pouch being folded inwardly thereby defining a recess 194. Gusseting permits flexibility in creating different fill volumes. The refill cartridge can also be standingly supported on the gussetted bottom.

The foregoing description and drawing represent several embodiments of the present invention but are not intended as limitations on the scope thereof, it being understood that the invention can be practiced through obvious modifications and rearrangements without departing from its essential spirit.

What is claimed is:

1. A refillable pump dispenser comprising:

(i) a container having a first and second end storing a pumpable product;

(ii) a pump means for drawing the product from the container and dispensing same, the pump means being positioned over the first end of the container and comprising:

(a) a connector tube with upper and lower ends, the lower end of the connector tube having a sharpened mouth which traverses a longitudinal axis of the connector tube at an acute angle;

(b) a collecting chamber for receiving product drawn upward from the connector tube;

(c) a one-way check valve interposed between the upper end of the connector tube and the collecting chamber;

(d) an elastomeric wall at least partially positioned over and communicating with the collecting chamber, the elastomeric wall being resiliently pressable thereby compressing the collecting chamber;

(e) a dispensing member communicating with the collecting chamber having an exit orifice through which product can flow outward;

(f) a one-way monitoring valve downstream from the collecting chamber controlling the outward flow through the dispensing member; and (g) a refill cartridge positioned within the container, the cartridge having a dispensing end communicating with the connector tube and through which product is drawn, the refill cartridge comprising a collapsible pouch having annular fitment across a dispensing opening of the pouch for securing walls of the pouch thereto, the annular fitment including a cone receptacle extending upward from a top surface of the annular fitment, the cone receptacle having a central recess with sidewalls configured in a taper ranging from 0.5° to 5°, and a frangible septum stretching across a full bore of the central recess along the taper to seal contents of the pouch.

2. The dispenser according to claim 1 wherein the annular fitment has a top and bottom surface, the fitment further comprising at least one projection extending from the top surface and a catch means on the at least one projection for coupling same to the pump means.

3. The dispenser according to claim 2 further comprising at least one arm positioned below the collecting chamber and directed downwardly, the at least one arm including a complementary catch means for releasably joining same to the catch means on the at least one projection.

4. The dispenser according to claim 1 wherein the dispenser member is a rotatingly pivotal turret nozzle.

5. The dispenser according to claim 4 wherein the turret nozzle nests within an elongate recess along an outer wall housing the pump means.

6. The dispenser according to claim 4 wherein the turret nozzle pivots on a pair of pinions.

7. The dispenser according to claim 4 wherein the turret nozzle includes a spout channel through which product can flow outward, the channel having a straight section and a downwardly tapered portion, the downwardly tapered portion being adjacent an outlet opening of the turret nozzle.

8. The dispenser according to claim 1 wherein the one-way monitoring valve is an elastomeric flap.

9. The dispenser according to claim 1 wherein the annular fitment includes an induction seal liner and a pouch ring, the collapsible pouch having edges secured to the pouch ring.

10. The dispenser according to claim 1 wherein the connector tube has a taper matching the taper of the central recess and when the connector tube is inserted within the central recess the matching tapers provide an airtight, positive engagement through a friction locking fit.

11. The dispenser according to claim 1 wherein the collapsible pouch includes a gusseted bottom.

12. The dispenser according to claim 1 further comprising a ring collar lockingly joining the open end of the container to the pump means.

13. The dispenser according to claim 12 wherein the ring collar further comprises a locking means for releasing the pump means from the container and thereby permitting exchange of the cartridge for a refill.

14. A refill cartridge comprising:

(i) a collapsible pouch having a closed end and a dispensing end;

(ii) an annular fitment positioned over the dispensing end to which walls of the pouch are attached; and (iii) a cone receptacle extending upward from a top surface of the annular fitment, the cone receptacle including a central recess having sidewalls configured in a taper ranging from 0.5° to 5°, and a frangible septum stretching across a full bore along the taper of the central recess to seal contents of the pouch.

* * * * *